US005857510A

United States Patent [19]

Krupke et al.

[11] Patent Number: 5,857,510

[45] **Date of Patent: *Jan. 12, 1999**

[54] REINFORCED SECTIONAL DOOR

[75] Inventors: LeRoy G. Krupke, Carrollton; Foad Vafaie, Plano; James L. Grisham, Denison; David Scott Boucher, Rowlett, all of Tex.

[73] Assignee: Overhead Door Corporation, Dallas, Tex.

[ * ] Notice: The term of this patent shall not extend beyond the expiration date of Pat. No. 5,842,508.

[21] Appl. No.: 789,785

[22] Filed: Jan. 29, 1997

[51] Int. Cl.[6] ..... E05D 15/06

[52] U.S. Cl. ..... 160/201; 160/232; 160/235; 160/236; 160/187; 52/71; 52/656.4; 52/457

[58] Field of Search ..... 160/201, 232, 160/235, 236, 266, 229.1; 52/71, 656.4, 457

[56] References Cited

U.S. PATENT DOCUMENTS

| | | | |
|---|---|---|---|
| 2,827,115 | 3/1958 | Stroup | 160/229 |
| 2,951,533 | 9/1960 | Lucas et al. | 160/201 |
| 3,216,102 | 11/1965 | Vecchiarelli | 160/235 |
| 3,891,021 | 6/1975 | Geoffrey | 160/235 |
| 4,142,931 | 3/1979 | Viol et al. | 160/231 R X |
| 4,183,393 | 1/1980 | Bailey | 160/232 |
| 4,238,544 | 12/1980 | Mullet | 428/71 |
| 4,339,487 | 7/1982 | Mullet | 428/71 |
| 4,433,714 | 2/1984 | Barber | 160/235 |
| 4,569,383 | 2/1986 | Wentzel | 160/201 |
| 4,685,266 | 8/1987 | Mullet | 52/309.11 |
| 4,779,325 | 10/1988 | Mullet | 29/460 |
| 4,924,932 | 5/1990 | Esnault | 160/235 X |
| 5,163,493 | 11/1992 | Kraeutler | 160/201 |
| 5,172,744 | 12/1992 | Finch et al. | 160/133 |
| 5,365,993 | 11/1994 | Jella | 160/232 X |
| 5,435,108 | 7/1995 | Overholt et al. | 52/309.11 |
| 5,509,457 | 4/1996 | Jella | 160/201 |
| 5,515,902 | 5/1996 | Hoffman | 160/235 |
| 5,601,133 | 2/1997 | Krupke et al. | 160/265 |
| 5,632,317 | 5/1997 | Krupke et al. | 160/265 |

FOREIGN PATENT DOCUMENTS

WO96/23948 8/1996 WIPO .

*Primary Examiner*—Daniel P. Stodola
*Assistant Examiner*—Bruce A. Lev
*Attorney, Agent, or Firm*—Akin, Gump, Strauss, Hauer & Feld, L.L.P.

[57] ABSTRACT

A sectional garage door is formed of rectangular door sections which include hollow extruded plastic rail members interconnected by hollow extruded plastic end and intermediate stile members to form a door section. The rail members and stile members may be fitted with internal tubular or channel shaped metal reinforcing members to minimize deflection of the door sections during use. The door sections may each include an externally fitted strut which is secured to a longitudinal side edge of a section and is connected directly to a reinforcing member disposed within one of the rail members without being forcibly connected to the rail member itself to allow for differential thermal expansion between the rail member and the reinforcing members. Rectangular panel inserts may be removably supported on each door section by removable retainer members and may include insulated panel inserts which may be added to the door sections before or after installation.

18 Claims, 11 Drawing Sheets

REINFORCED SECTIONAL DOOR

FIELD OF THE INVENTION

The present invention pertains to a sectional door, such as an upward acting garage door fabricated of reinforced extruded plastic members.

BACKGROUND

Upward acting or vertical opening sectional doors are ubiquitous as residential garage doors and are also widely used in commercial door applications. There has been a continuing need to provide improvements in sectional doors of the general type referenced herein. One pressing need has been to reduce the weight of the door, particularly for doors used to close over openings in residential or commercial multi-car garages. These doors typically range in widths from eight to twenty feet and have a height of about seven feet. It is desirable to minimize the weight of the door while not sacrificing its strength and rigidity to provide a suitable secure insulated or noninsulated closure over the garage vehicle entry. In this regard extrudable or moldable polymer materials have been given consideration for use as the main structural members of doors. However, the use of these materials with other door support components has posed certain problems with respect to providing adequate strength of the door sections and accommodation of thermal expansion and contraction of the polymer materials as compared with metal door structural components or door structural components of other materials used in conjunction with the polymer materials. Moreover, it is desirable to provide a door structure which can be easily modified to include substantial or minimal thermal and/or acoustic insulation.

Another problem associated with the development of sectional vertical opening doors as well as other doors which utilize multiple door sections or panels which are hinged to each other is the development of a suitable hinge structure which can be an integral part of the door structural members and providing a long operating life, particularly with minimal or little maintenance, is adapted to minimize injury, such as by being configured to substantially prevent placement of a person's finger or fingers between the do or sections during pivotal movement thereof, provides a suitable light seal and weather seal, and provides for assembly of the door sections laterally with respect to each other instead of requiring a longitudinal end-to-end sliding fit of the door sections with respect to each other in order to assemble the hinge.

SUMMARY OF THE INVENTION

The present invention provides an improved sectional door, particularly an upward acting or vertical opening type door, adapted to be used for covering entries to residential and commercial garages and similar structures.

In accordance with one aspect of the present invention, a lightweight, sectional, upward acting door is provided which is formed of extrudable or moldable material, preferably extruded plastic, and is characterized by hingedly interconnected door sections, each section preferably being formed of extruded, longitudinal, horizontal rails, interconnecting vertical stiles and removable inserts or panels. The longitudinal rails and interconnecting stile members are preferably cemented or welded together to form a substantially rigid structure. The rails and stiles are also provided with elongated internal passageways or spaces for receiving reinforcing members. The reinforcing members are preferably formed of elongated metal tubing or channel components.

In accordance with another aspect of the present invention a lightweight sectional door is provided having reinforcing members which are connected to the door in a way which allows for differential thermal expansion of door components without stressing or distorting the door. In particular, an elongated reinforcing strut extends across the top edge of the door adjacent to the point of connection of a door operator mechanism for opening and closing the door, which strut is connected directly to a reinforcing member disposed within a passageway formed in a top rail of the door and in such a way as to allow differential thermal expansion between the door rail and the strut and reinforcing members. Additional struts may be connected to one or more door sections, as needed for reinforcing and stiffening the door against external forces as well as the weight of the door sections.

In accordance with still another aspect of the present invention a sectional door is provided wherein multiple door sections are hingedly connected to each other by a continuous hinge assembly wherein two major components of the hinge assembly are integral with adjacent door structural members, respectively, and are preferably formed as arcuate bearing members which are interfitted with each other to provide a pivot connection between adjacent door sections. The hinge assembly also provides a continuous hinge which has large bearing surface areas to provide a hinge connection between large door sections with reduced stresses thereon. Moreover, the hinge construction does not require separate seal members or structure necessary to make the hinge substantially pinch proof.

The present invention still further provides a sectional door having an improved modular panel insert support structure wherein door panel inserts with minimal thermal and/or acoustic insulation capability may be used or be interchanged with panel inserts having substantial thermal and/or acoustic insulation characteristics.

Those skilled in the art will further appreciate the above-described advantages and superior features of the invention together with other important aspects thereof upon reading the detailed description which follows in conjunction with the drawing.

DESCRIPTION OF THE PREFERRED EMBODIMENT

Figure 1:
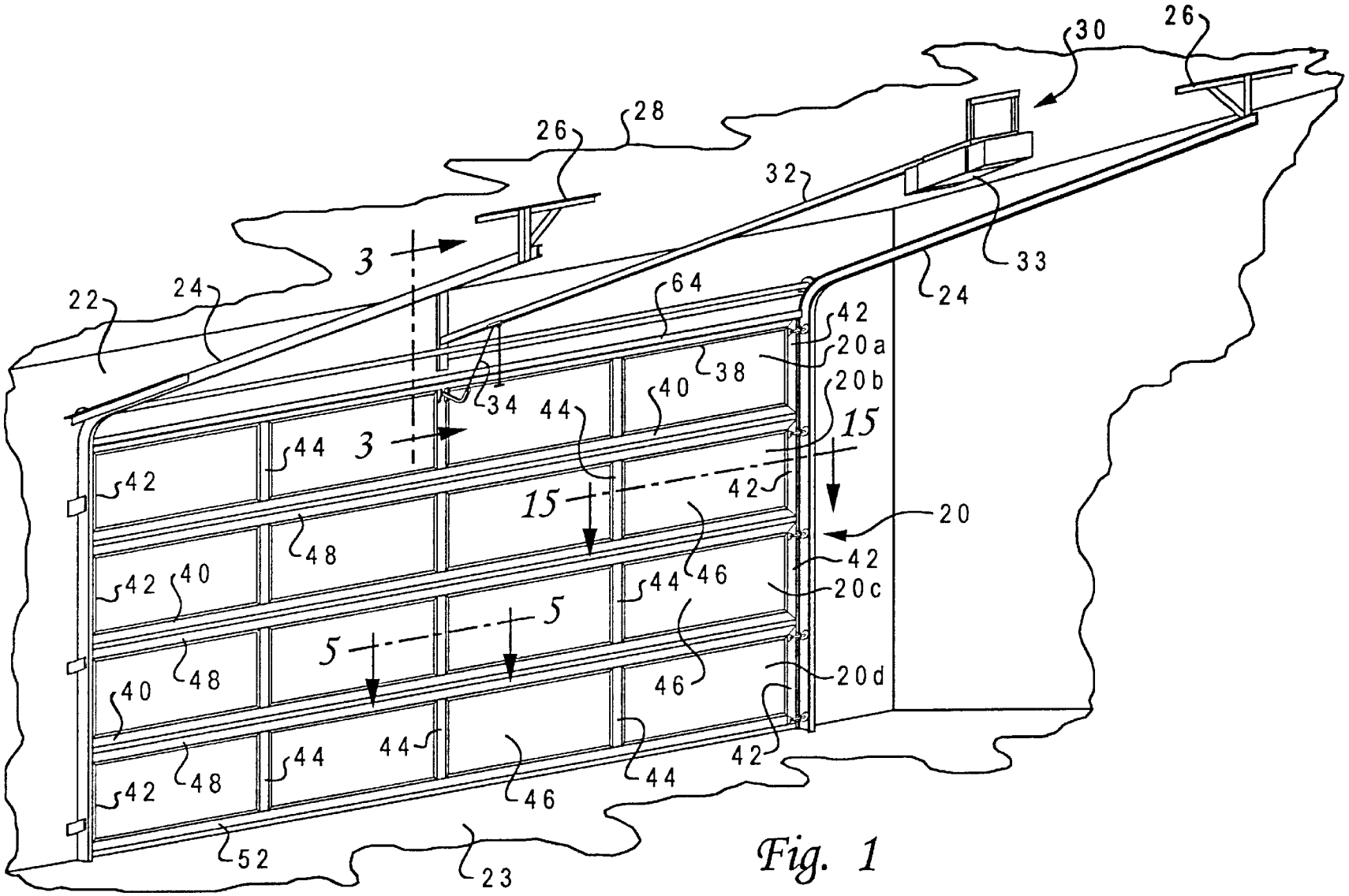
FIG. 1 is a perspective view of a sectional, upward acting garage door in accordance with the present invention.

In the description which follows like parts are marked throughout the specification and drawing with the same reference numerals, respectively. The drawing figures are not necessarily to scale and certain elements may be shown in schematic or generalized form or omitted from certain views in the interest of clarity and conciseness.

Figure 2:
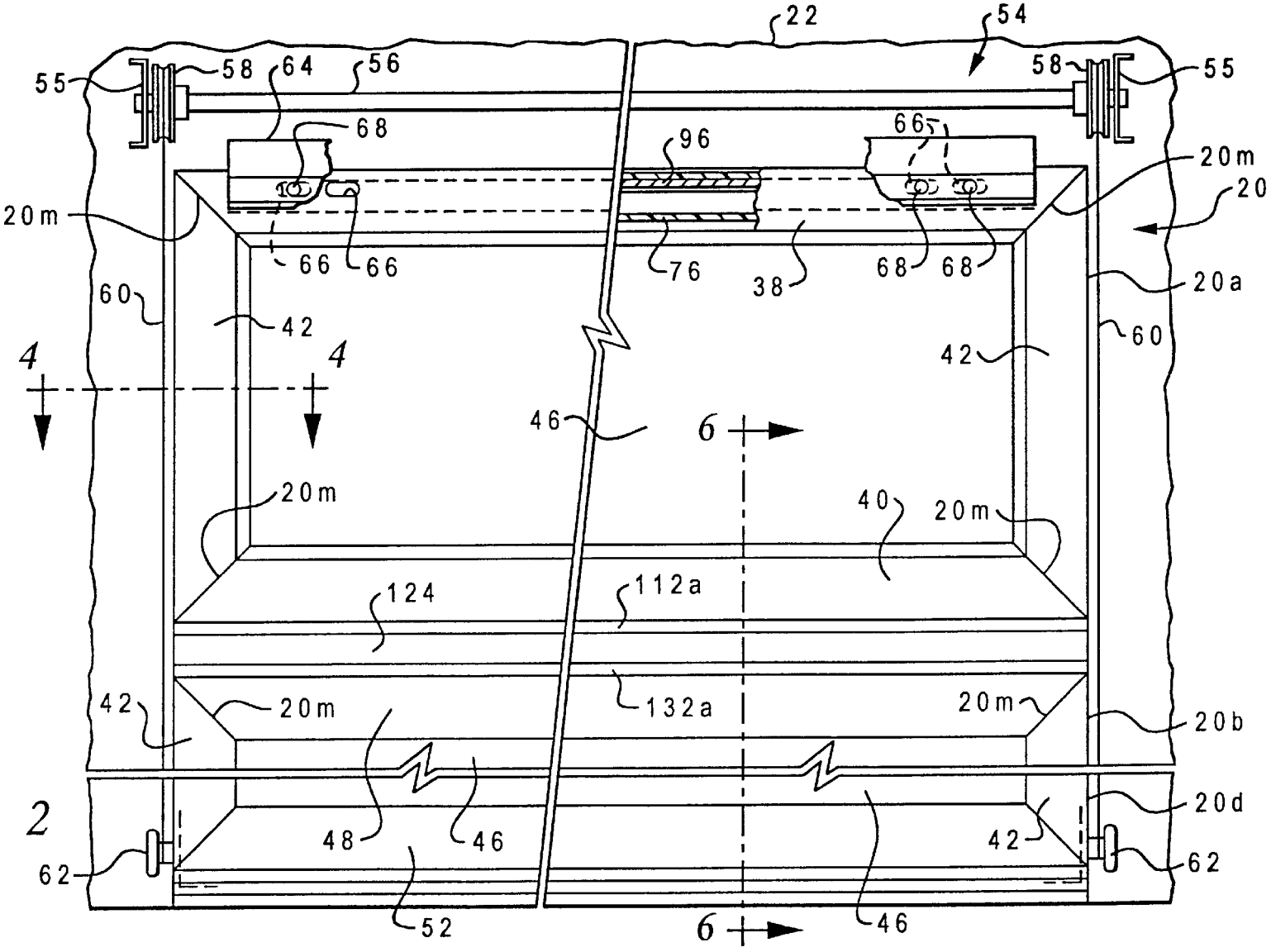
FIG. 2 is a partial elevation of the inward facing side of the door shown in FIG. 1.

Referring to FIGS. 1 and 2, a sectional, upward acting door in accordance with the present invention is illustrated and generally designated by the numeral 20. The door 20 is illustrated as a double width sectional garage door adapted to close over a vehicle entry opening formed in a vertical wall 22, for example. The door 20 is supported for movement between open and closed positions on spaced apart opposed guide tracks 24 of conventional construction, which tracks are supported at wall 22 in a conventional manner and also by depending support brackets 26 depending from a garage ceiling 28. The door 20 is operable to be moved between open and closed positions by a motor driven operator mechanism of conventional design and generally designated by the numeral 30. The operator mechanism 30 includes a linear traversal device such as a rotating screw or roller chain, not shown, and supported on a beam 32 extending between a motor unit 33 for the operator mechanism 30 and the wall 22. An arm 34 is operable to interconnect the motor driven operator mechanism 30, including the aforementioned device, and the door 20. the arm 34 may be of conventional design and be connected to the operator mechanism in a conventional manner.

The door 20 is shown in a closed position in FIG. 1 covering the aforementioned opening in wall 22 and extending across the opening with its lower edge directly adjacent a floor 23. The door 20, in the embodiment shown, comprises four interconnected sections 20*a*, 20*b*, 20*c* and 20*d*. The door sections 20*a* through 20*d* are interconnected by improved hinge means between adjacent sections to be described in further detail herein.

Referring further to FIG. 1 and also FIG. 2, the door section 20*a* is characterized by an elongated top rail member 38, and a generally parallel and coextensive lower rail member 40 spaced from the top rail. The top and lower rail members 38 and 40 are interconnected by spaced apart vertical end stiles 42. Intermediate vertical stiles 44 also extend between the rail members 38 and 40. The rail members 38 and 40 and the stiles 42 and 44 support generally planar solid panel inserts 46 which may be removable from the section 20*a*, as will be described further herein.

Door sections 20*b* and 20*c* are identical and are each characterized by a longitudinal upper rail member 48, a longitudinal lower rail member 40, opposed vertical end stiles 42 and intermediate and center stiles 44 which also support panel inserts 46 therebetween in the same manner as for the section 20*a*.

Bottom section 20*d* is characterized by an elongated upper rail 48, and a lower, generally parallel longitudinal bottom rail member 52 spaced therefrom. The rail members 48 and 52 are also interconnected by end stiles 42 and by center and intermediate stiles 44 which, in combination with the rails 48 and 52, support panel inserts 46. As shown in FIG. 2, the door 20 is also adapted to be counterbalanced by a conventional counterbalance mechanism, generally designated by the numeral 54, including opposed brackets 55 mounted on wall 22 and supporting a counterbalance shaft 56 having opposed cable drums 58 supported thereon for rotation to pay out or reel in opposed counterbalance cables 60. The cables 60 are connected at their lower ends to respective guide rollers 62 suitably connected to the bottom section 20*d*. The guide tracks 24 are omitted from FIG. 2. The counterbalance mechanism 54 may be of a conventional configuration wherein one or more torsion springs, not shown, are operable to bias the shaft 56 to rotate in a direction which exerts an upward acting force on the door 20 through the cables 60 to counterbalance at least a significant portion of the weight of the door.

Due to the concentrated force exerted on the door 20 by the operator mechanism 30, and considering the construction of the door, which will be explained in further detail herein, the upper section 20*a* advantageously includes an elongated support struts 64 extending substantially across the section 20*a* and secured to the rail 38 adjacent the upper horizontal edge thereof. In this regard the rail 38, which is an elongated substantially hollow extruded member, has plural spaced apart slots 66, four shown in FIG. 2, formed therein and coinciding with corresponding openings 68 formed in strut 64 for receiving fasteners for securing the strut to the door section 20*a*, also in a manner to be described further herein. Thanks to the provision of the strut 64, the forces exerted on the door 20 by the operator mechanism 30 are distributed over the door section 20*a* in such a way as to minimize any severe stress on or deflection of the rail 38.

Figure 3:
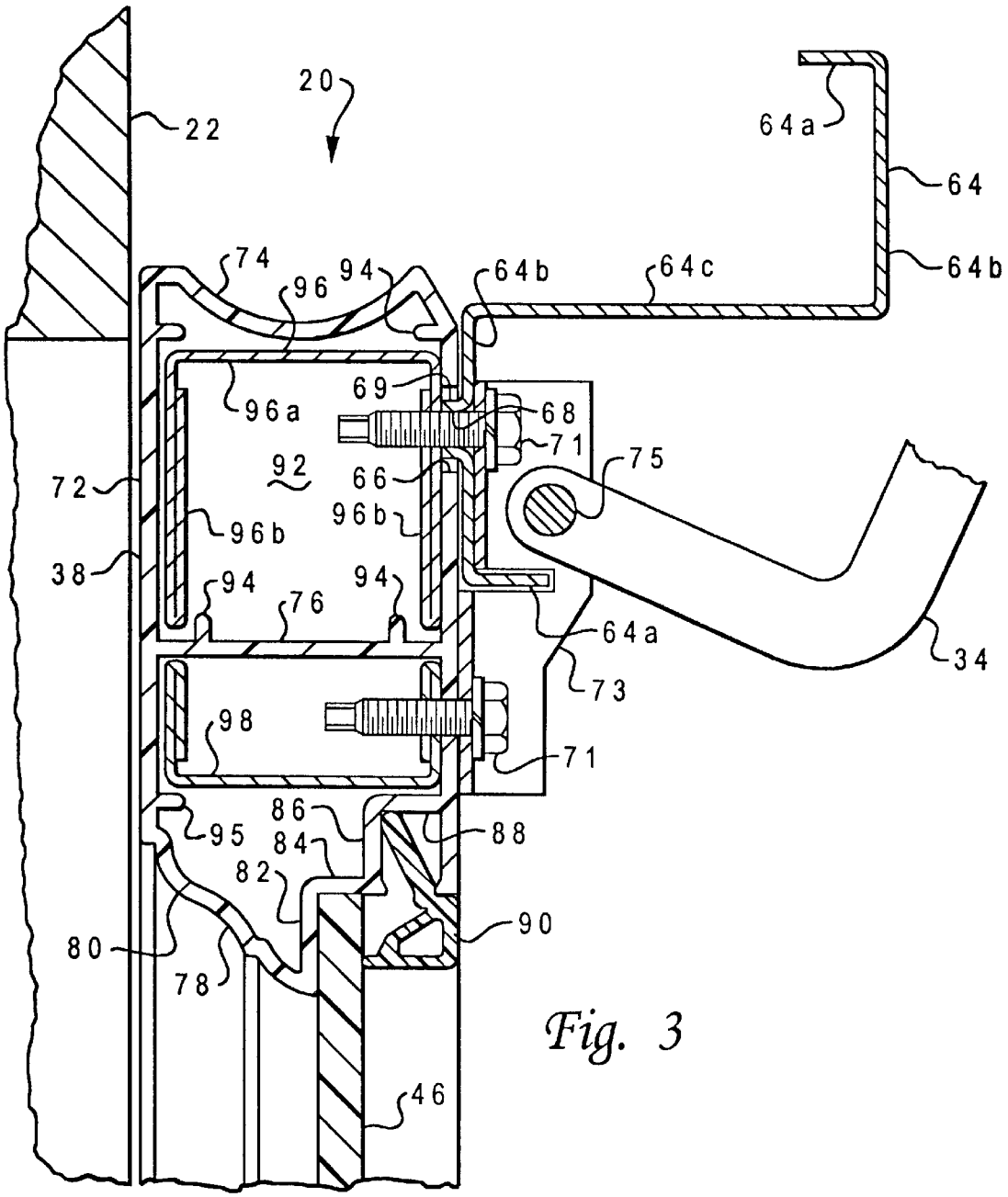
FIG. 3 is a detail section view taken generally along the line 3—3 of FIG. 1.

Referring now primarily to FIG. 3, the top rail 38 is shown in right cross-section in the closed position of door 20 disposed adjacent to wall 22. The top rail 38 is characterized as an elongated hollow plastic extrusion, preferably formed of a suitable all weather grade of a vinyl polymer and having a nominal wall thickness of about 0.070 inches to about 0.080 inches of opposed inner and outer side walls 70 and 72 formed integral with a connecting concave top wall 74, an intermediate wall 76 and a bottom wall 78. Bottom wall 78 has a suitable ornamental configured outer portion 80, a shoulder portion 82 substantially coplanar with walls 70 and 72, a transverse portion 84 contiguous with the shoulder 82 and a portion 86 forming with the inner wall 70 an elongated recess 88 for receiving a panel retainer strip 90. Retainer strip 90 is adapted for releasably retaining a panel insert 46 supported by the shoulder 82 and the transverse wall portion 84, as illustrated.

A generally rectangular elongated interior passage 92 is formed between walls 70, 72, 74 and 76, and elongated projections 94 are suitably formed by the respective wall portions, as shown, and projecting into the passage 92. Projections 94 are operable to stiffen the rail 38 and for supporting an elongated reinforcing member 96 which is substantially coextensive with the passage 92. A similar reinforcing member 98 may be disposed in the rail member 38 between the intermediate wall 76, a locating projection 95 and the wall portion 86, as shown. The reinforcing member 96 may be a rectangular cross-section metal tube or an inverted, folded flange metal channel member, as shown, having a web 96*a* and opposed flanges 96*b* with folded over distal end portions, as illustrated. The reinforcing member 98 may be similarly configured, as illustrated.

Figure 4:
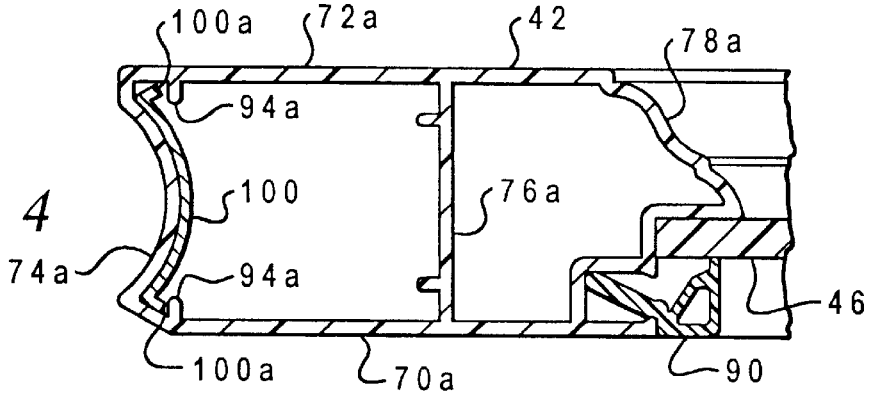
FIG. 4 is a section view taken generally along the line 4—4 of FIG. 2.

As shown in FIG. 4, the end stiles 42 may have a cross-sectional configuration substantially like the top rail 38 and may be formed of the same extrusion member to provide walls 70*a*, 72*a*, 74*a*, 76*a* and 78*a*. As shown in FIG. 4, two of the projections 94*a* adjacent the concave wall 74*a* for the end stile 42 may be provided to support a metal plate reinforcing member 100 having a somewhat arcuate shape to conform to the concave end wall 74*a* and having respective opposed tabs 100*a* engageable with the projections 94*a* to retain the reinforcing member 100 in the position shown. One or more reinforcing members 100 may be disposed in the end stiles 42 for supporting fasteners for connecting certain components to the end stiles.

Figure 5:
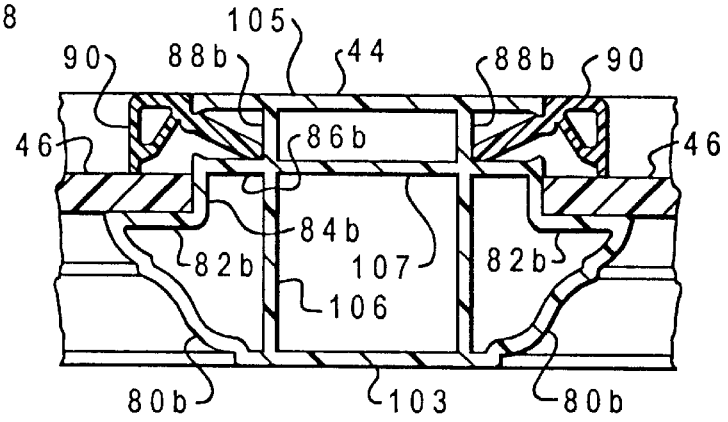
FIG. 5 is a detail section view taken generally along the line 5—5 of FIG. 1.

FIG. 5 is a cross-section view of one of the intermediate or center stiles 44 which are also formed of extruded polymer to have opposed, generally parallel, planar outer and inner wall portions 103 and 105, ornamental opposed wall portions 80*b*, shoulders 82*b* and transverse wall portions 84*b* which are contiguous with wall portions 86*c* defining slots 88b similar to the configuration of the rail member 38 and the stiles 42. Intermediate wall or web portions 106 and 107 reinforce the outer wall portions aforedescribed. The opposite ends of each of the stiles 44 are cut to conform to the cross-sectional shape of the wall portion 80, 82, 84 and 86 of the rails, such as the rail 38.

The cross-sectional configuration of lower rails 40, upper rails 48 and bottom rail 52 are essentially identical with respect to the architectural or ornamental shaped wall portions corresponding to the wall portions 80, 82, 84 and 86 shown for rails 38, end stiles 42 and center stiles 44. Other portions of the rails 40, 48 and 52 will be described further herein. As shown in FIG. 2, the door sections 20*a*, 20*c* and 20*d* are made up of rail members and end stile members which may be cut to form mitered joints 20*m*, as shown by way of example for door section 20*a*, which joints are suitably adhesively or thermally bonded to form a substantially rigid door section. However, if reinforcing members such as the channel members 96 and 98 are to be inserted in the rail members 38, 40, 48 or 52, such is preferably done before the door sections are assembled and the rails bonded to the end stiles 42. The center stiles 44 may also be bonded to the opposed rail members of each door section during assembly of the rails to the end stiles.

Thanks to the provision of the reinforcing members 96 and 98, additional stiffness of each of the door sections 20*a*, 20*b*, 20*c* and 20*d* is obtained. In a double width door, such as the door 20, it is advantageous to provide reinforcing members 96 in each of the rail members 38, 40, 48 and 52. However, in a door for a single vehicle width garage entry, reinforcing members 96 may be inserted only in the top rail 38, as shown in FIG. 3, and in the bottom rail 52. FIG. 6B shows a modified reinforcing member 96*t* disposed in the interior of bottom rail 52 and comprising a generally rectangular cross-section metal tube extending substantially coextensive with the bottom rail 52.

Referring again to FIG. 3, the strut 64 preferably has a somewhat Z shape including distal flanges 64*a*, parallel webs 64*b* and a connecting web 64*c*. One of the webs 64*b* is provided with the spaced apart fastener receiving holes 68 which are defined by cylindrical tubular flange or spacer portions 69, one shown in FIG. 3, which have a length greater than the wall thickness of the rail sidewall 70. FIG. 3 illustrates how the strut 64 is secured to the door 20 wherein a plurality of threaded fasteners 71 comprising, for example, self tapping metal screws, are operable to secure the strut 64 to a flange 96*b* of the reinforcing member 96. Plural fasteners 71 may be utilized to secure the strut 64 to the upper door section 20*a*, as shown, and wherein the strut 64 does not forcibly engage the rail wall 70. Due to the differential thermal expansion between a polymer material, such as vinyl, and a metal, such as steel or aluminum used for the strut 64 and the reinforcing member 96, it is important that the strut not be forcibly clamped to the wall 70 of the rail 38. In this way the differential thermal expansion between the rail 38, the strut 70 and the reinforcing member 96 over the substantial length of these members may be allowed to occur without distortion or damage, particularly to the rail 38, or any rail to which a strut 64 is attached in like manner.

The particular fasteners 71 shown in FIG. 3 also secure a somewhat channel shaped bracket 73 to the strut 64 and the reinforcing member 96, as shown. The bracket 73 is operable to form a connection point for the operator arm 34 which is suitably pivotally connected to the bracket 73 by a pivot pin 75, as shown. The bracket 73 may also be secured to the rail 38 by a fastener 71 which is threadably engaged with the reinforcing member 98. The short length and width of the bracket 73 is such that the differential thermal expansion between the bracket and the wall 70 is not significant compared with the difference in lengths which will result from differential thermal expansion between members such as the strut 64 and the rail 38, due to the substantial length of these members ranging from 8 to 20 feet, for example.

Figure 16:
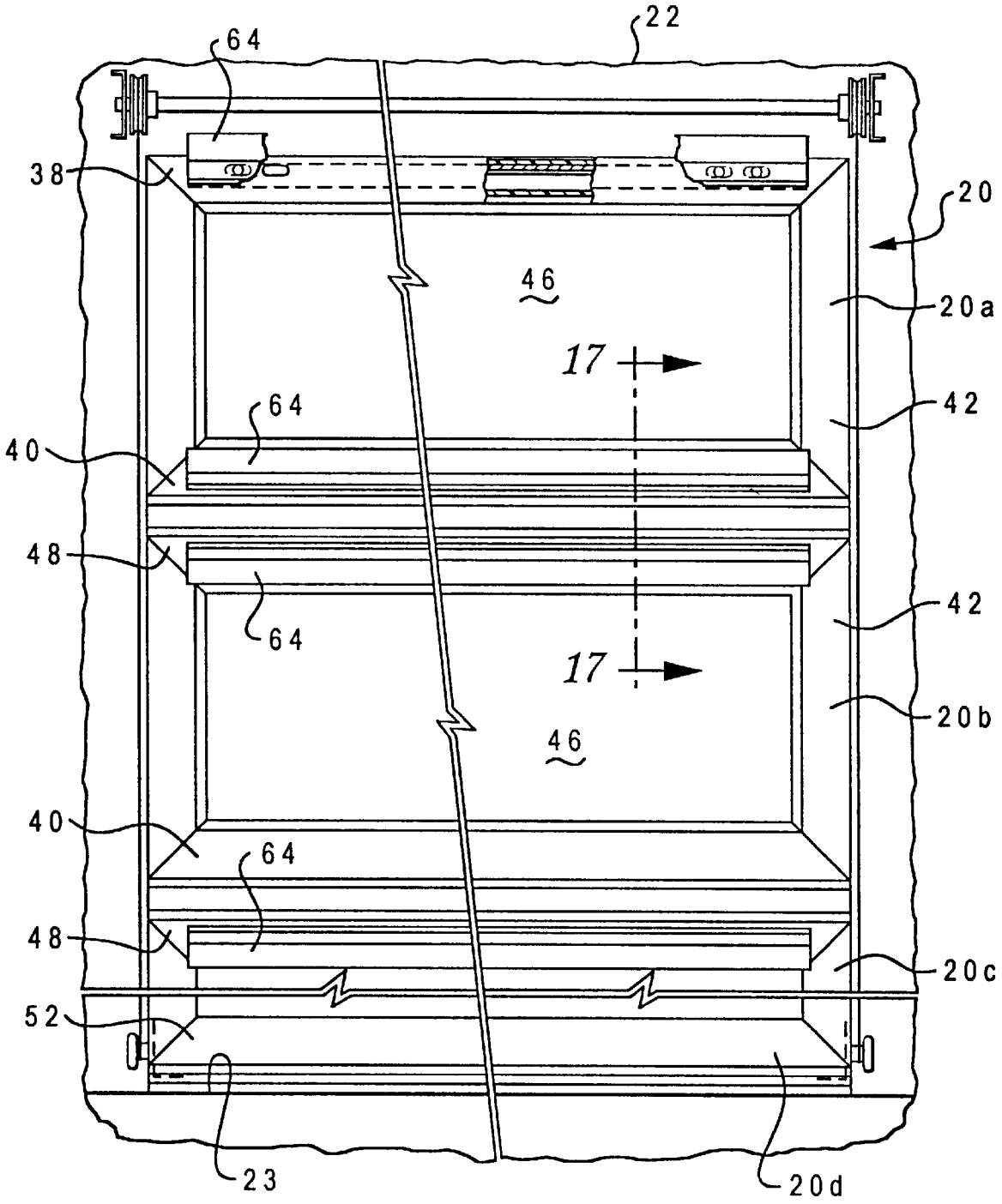
FIG. 16 is an inside elevation of the door shown in FIGS. 1 and 2 modified to include plural reinforcing struts.
Figure 17:
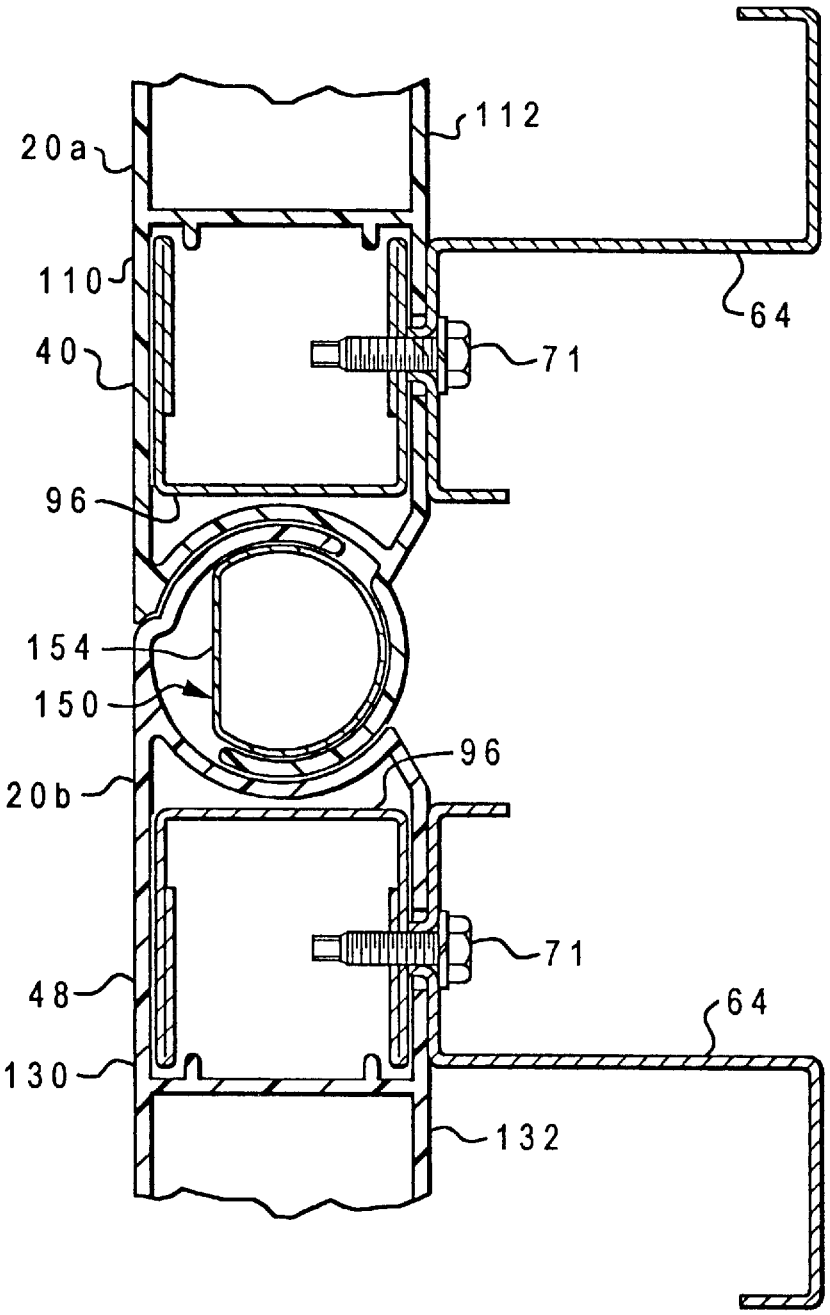
FIG. 17 is a section view taken along the line 17—17 of FIG. 16.

Referring briefly to FIGS. 16 and 17, the door 20 may be modified to provide struts 64 extending across the rail members 40 and 48 of door sections 20*a*, 20*b*, 20*c* and/or 20*d*. Depending on the strength and stiffening requirements of a door, dictated by the door overall width or span and external forces which may act on the door, struts 64 may be secured to the top and/or bottom rail members of each of the sections 20*a* through 20*d* or to selected ones of the rail members 38, 40, 48 and 52, as desired. By way of example, struts 64 are secured to the top and bottom rail members 38 and 40 of section 20*a*, the top rail member 48 of section 20*b* and the top rail member 48 of section 20*c*, as illustrated in FIG. 16.

FIG. 17 illustrates a preferred orientation of the struts 64 when placed on a bottom rail member 40 of one door section and a top rail member 48 of an adjacent door section so that the struts do not interfere with each other when the door sections are pivoted relative to each other during opening and closing movements of the door. Each of the rail members 40, 48 and 52 is, of course, preferably provided with suitable slots similar to the slots 66 in the rail member 38 to provide clearance for the tubular flange portions 69 of the struts 64 so that the struts may be forcibly secured to reinforcing members 96 or 96*t*, as shown without being forcibly clamped to the rail members themselves. In this way, as discussed previously, differential thermal expansion between the struts 64 and the rail members does not result in any distortion or damage to the door.

Figure 6A:
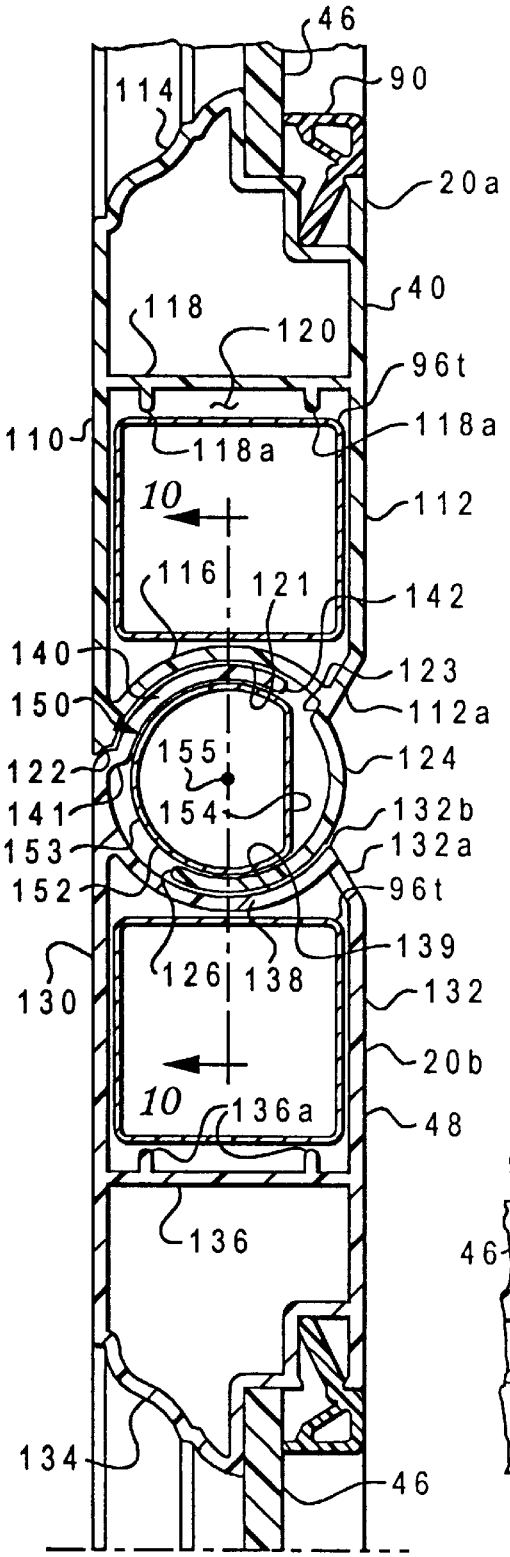
FIGS. 6A and 6B are section views taken generally along the line 6—6 of FIG. 2.
Figure 6B:
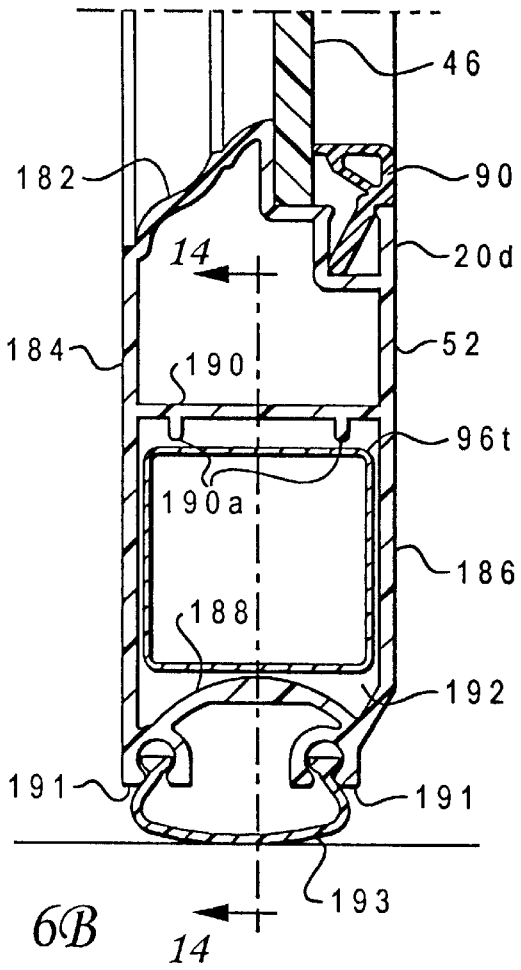

Referring now to FIG. 6A, rail members 40 and 48 are shown in cross section as part of adjacent connected door sections 20*a* and 20*b*. These rail members 40 and 48 are also formed as extrusions of a suitable material such as the aforementioned vinyl polymer. The polymer may include a lubricous material, such as silicone, as part of the polymer composition to provide self lubrication of hinge structure described herein. Rail member 40 includes opposed, generally parallel, planar, spaced apart outer and inner walls 110 and 112, and a transverse top wall 114, configured identical to the wall 78 of rail member 38 and stiles 42, for supporting a panel insert 46 retained therein by a retainer 90. Outer and inner walls 110 and 112 are interconnected by a concave bottom wall 116 and an intermediate wall 118 forming an elongated interior space 120 for receiving an elongated reinforcing member 96*t*, for example. The member 96*t* may be replaced by a member 96, if desired. Projections 118*a* depend from the wall 118 to retain the reinforcing member 96*t* from substantial movement within the space 120. The bottom wall 116 forms an arcuate bearing surface 121 which terminates at a lower transverse edge 122 at the juncture between wall 116 and wall 110. The opposite end of bearing surface 121 terminates at a shoulder 123 defined by the juncture of an inclined wall portion 112*a* with a continuous arcuate bearing member 124 formed integral with the rail 40 and extending from the inclined wall portion 112*a*. Wall portion 112*a* is integral with the inner wall 112. The arcuate hinge bearing member 124 terminates at a distal edge 126 leaving a gap between edge 126 and edge 122 in the position of the door sections shown in FIG. 6A.

In like manner, the upper rail 48 is formed of extruded polymer material, such as vinyl, and is defined by a planar outer wall 130, and a parallel, planar inner wall 132. Walls 130 and 132 are joined by a bottom wall 134 identical in configuration to walls 114 and 78, an intermediate wall 136 and an arcuate concave wall 138 forming a bearing surface 139 and interconnecting the walls 130 and 132, as shown. A short inwardly tapered or inclined portion 132*a* of wall 132 is provided, as shown, and terminates at an edge 132*b*. The rail 48 includes an integral, continuous, arcuate hinge bearing member 140 projecting from the wall 130 toward the wall 132 and is delimited by a distal edge 142. Bearing member 140 is operable to engage bearing surface 121 of the wall 116 and is rotatable relative to rail 40. As will be apparent from viewing FIG. 6A, bearing or hinge members 124 and 140 are operable to slide along the bearing surfaces 139 and 121, respectively, as door section 20*a* rotates relative to door section 20*b*, for example. Bearing surface 139 is delimited by a shoulder 141 formed at the juncture of bearing member 140 with the walls 130 and 138, as shown.

An elongated hinge member 150 is disposed between bearing members 124 and 140, and is characterized by a circular segment wall portion 152 and a generally planar wall portion 154 to give the hinge member a somewhat backward "D" cross sectional shape, viewing FIG. 6A. The hinge member 150 is preferably formed as a tubular member, as shown, to reduce its weight and may be formed of a suitable extrudable or rolled metal, such as aluminum or steel. When the hinge member 150 is positioned between the hinge bearing members 124 and 140 and is rotated to the position shown in FIG. 6A, it may be secured to the rail 48 by members to be described in further detail herein and thus remains fixed relative to bearing member 140 while allowing the rail 40 and the door section 20*a* to pivot about a central axis 155 which is essentially the central axis of arcuate hinge bearing members 124 and 140 when assembled as well as the axis of the arcuate bearing surfaces 139 and 121. Accordingly, the arcuate wall 138, forming the bearing surface 139 journals the bearing member 124 and the arcuate wall 116, forming the bearing surface 121 also journals the bearing member 140. Still further, the bearing member 124 is engageable with the outer cylindrical surface 153 of bearing member 150 to transfer forces between bearing member 124 and hinge member 150 and bearing member 140.

Figure 7:
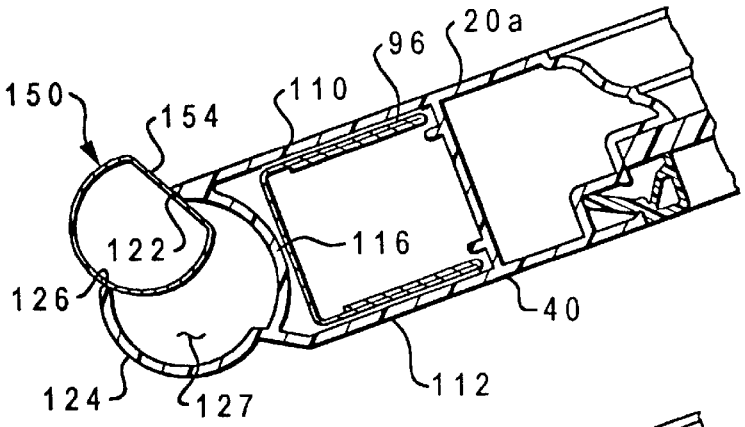
FIG. 7 is a detail section view of one of the lower rail members of a door section showing insertion and removal of a circular segment shaped tubular hinge member.
Figure 8:
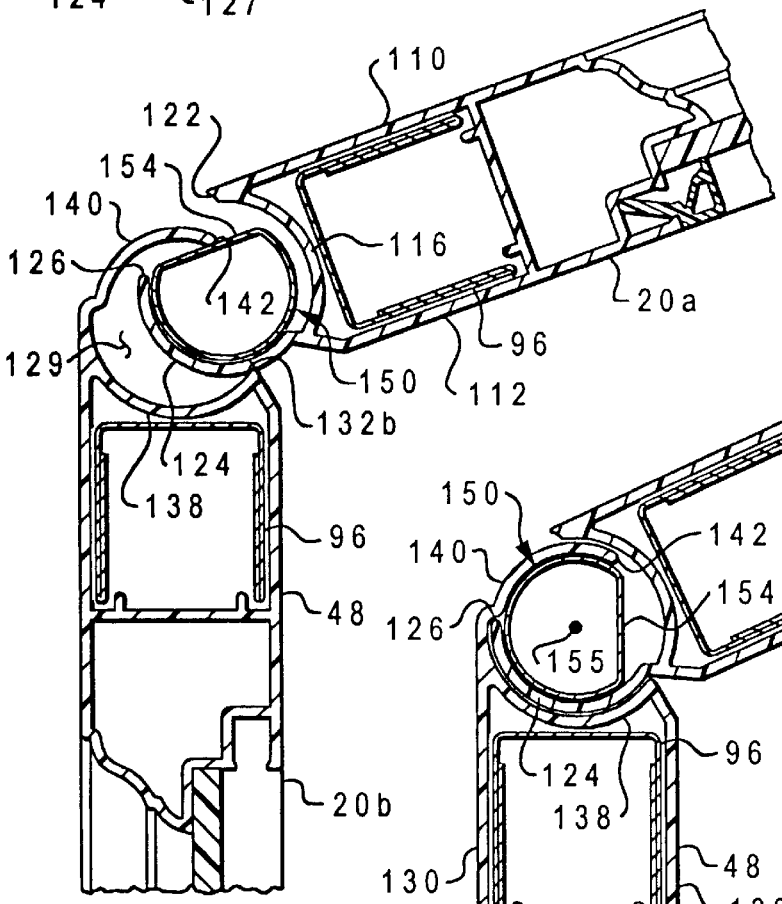
FIG. 8 is a detail section view showing upper and lower rail members of adjacent sections and a tubular hinge member being assembled to each other.
Figure 9:
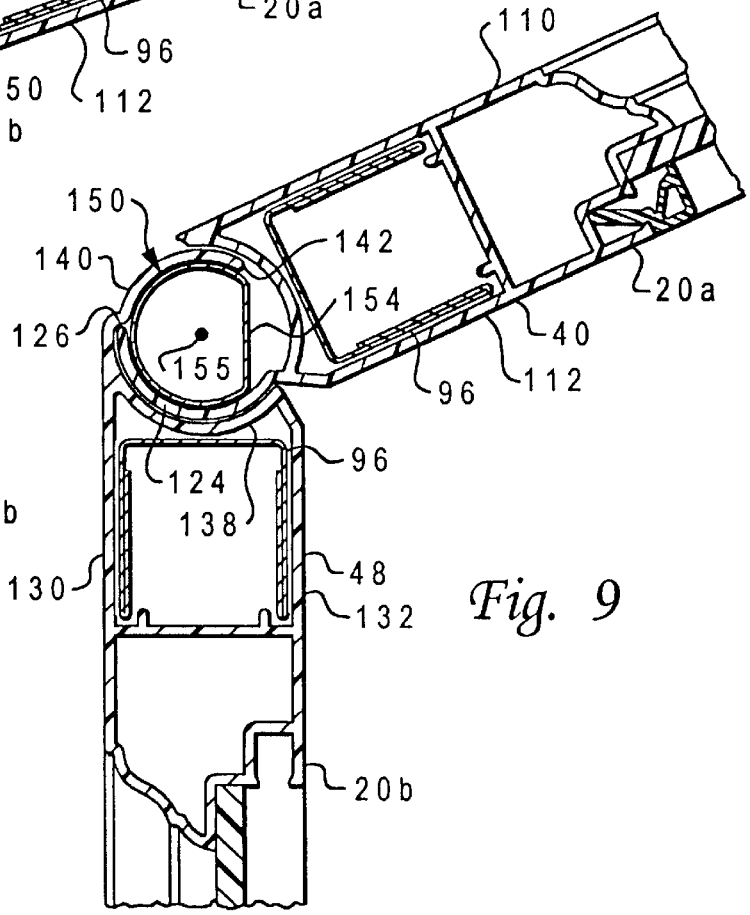
FIG. 9 is a detail section view showing one of the hinge connections between adjacent door sections in a folded position of one door section relative to the other.

One aforementioned advantage of the hinge assembly, comprising the hinge bearing members 124 and 140 and the hinge member 150, is illustrated in FIGS. 7, 8 and 9. Referring to FIG. 7, the hinge assembly between adjacent door sections 20*a* and 20*b*, or 20*b* and 20*c*, or 20*c* and 20*d*, may be assembled or disassembled by placing the hinge member 150 within space 127 defined by bearing member 124 and arcuate wall 116 by sliding the hinge member 150 through the gap between the distal end 126 and the edge 122, as illustrated. Once the hinge member 150 is placed within the space 127 and cradled by the bearing member 124 it may be rotated to a position wherein the planar portion 154 is generally parallel to walls 110 and 122 of the rail 40 and aligned with the distal end 126. The bearing member 124 may then be inserted in space 129 defined between bearing member 140 and arcuate wall 138, as shown.

Once the bearing member 124 is journalled by the bearing surface 139, the hinge member 150 may be rotated to the position shown in FIG. 9, having the planar surface 154 generally parallel to walls 130 and 132 and aligned with distal end 142 of bearing member 140. In this position of the hinge member 150, the rail members 40 and 48 are locked together while permitting pivotal movement of the door sections of which they are a part, respectively, to rotate relative to each other between, generally the position shown in FIG. 9 and the position shown in FIG. 6A.

The disassembly of the hinge connections between adjacent door sections 20*a* and 20*b*, 20*b* and 20*c*, and 20*c* and 20*d* may be carried out by substantially reversing the steps above-described for each hinge. As previously discussed, a major advantage of the hinge assembly formed by the bearing members 124, 140 and the hinge member 150 resides in the fact that the hinge is continuous across the door, may be assembled by sliding the bearing members 124 and 140 into engagement by longitudinal movement of the adjacent door sections relative to each other. This lateral assembly and disassembly of the hinge is particularly important when a door is being assembled or disassembled within a building, such as a residential garage, wherein there is woefully inadequate space for assembling a garage door by moving one section of the door longitudinally its entire length relative to the adjacent section. Such action is unwieldy and difficult to accomplish, even when space is available.

Figure 10:
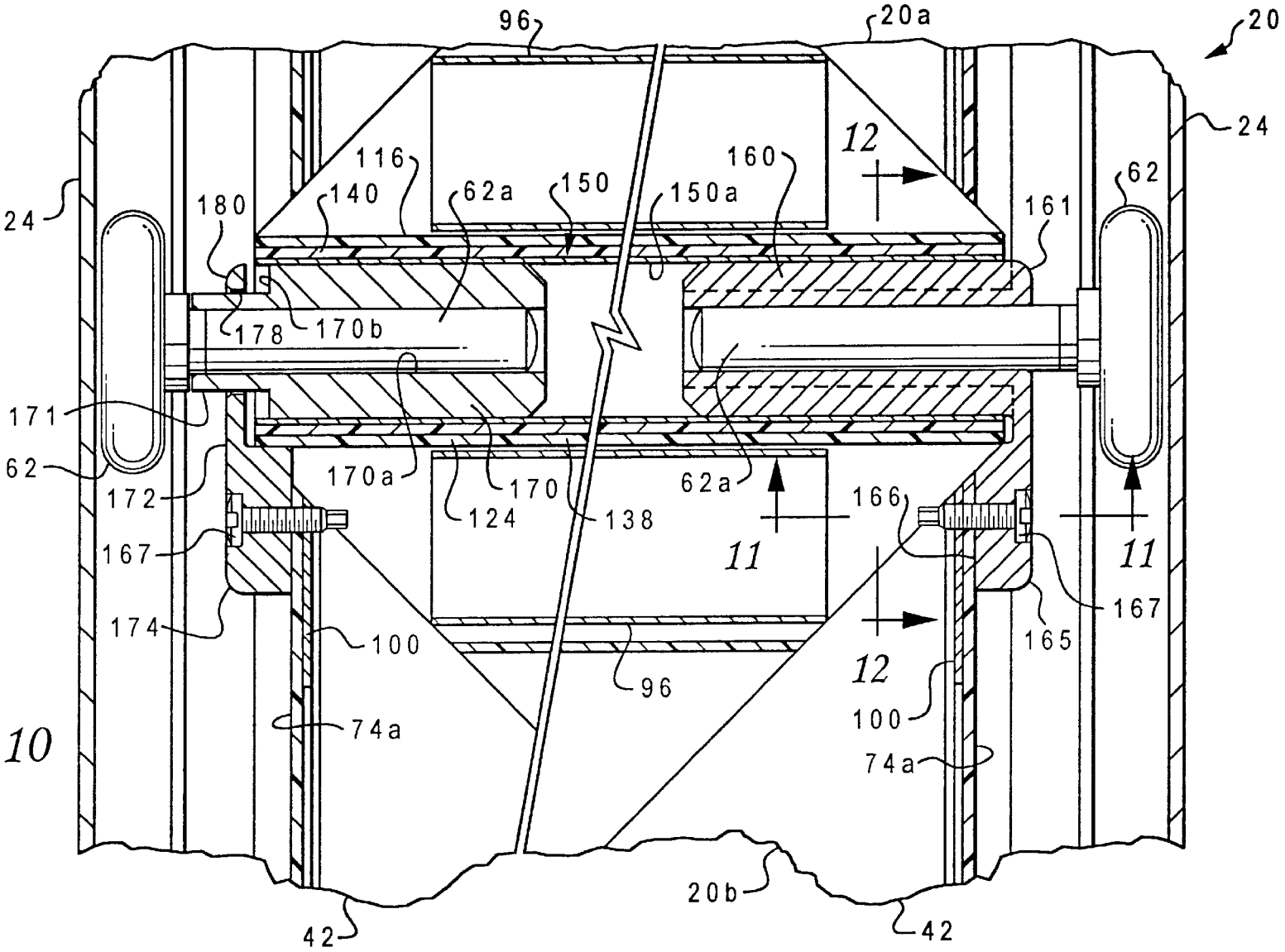
FIG. 10 is a detail section view taken along line 10—10 of FIG. 6A, showing opposite ends of the tubular hinge member and the associated retainer members for retaining the hinge member in its working position.
Figure 11:
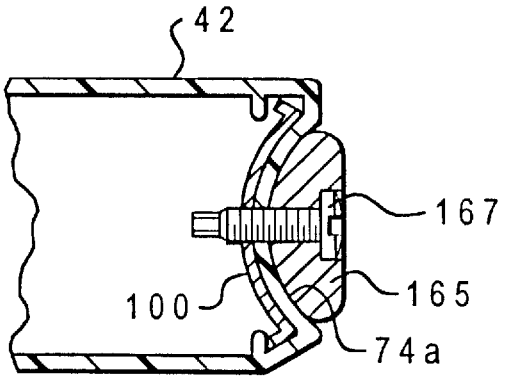
FIG. 11 is a detail section view taken from the line 11—11 of FIG. 10.
Figure 12:
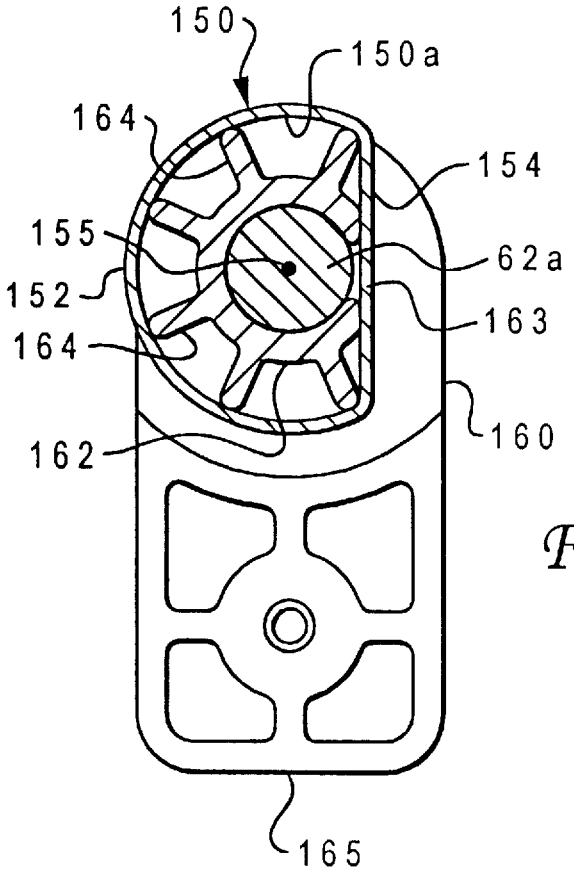
FIG. 12 is a view taken generally from the line 12—12 of FIG. 10.

Referring now to FIGS. 10, 11 and 12, the hinge member 150 is retained in its working position shown in FIGS. 6A, 9 and 10 by a retainer 160 comprising a member having a generally tubular hub 162, FIG. 12, and radially extending circumferentially spaced elongated fingers 164. The hub 162 has a planar surface 163 for registering with the inner surface of planar wall 154 of the hinge member 150 to prevent rotation of the hinge member with respect to the retainer member 160.

The retainer member 160 is insertable in bore 150*a* of hinge member 150 and includes, at its outer distal end 161, FIG. 10, a radially projecting arm 165 having a convex surface 166, FIGS. 10 and 11, operable to conform to the wall 74*a* of the end stile 42, see FIG. 11. The arm 165 is provided with a suitable bore for receiving a threaded fastener 167, such as a self-tapping screw, which is operable to be drilled through the wall 74*a* and a reinforcing member 100 for securing the retainer to the end stile 42 of section 20*b*, for example. The arm 165 is aligned with the surface 163, such that when the arm is nested against wall 74*a*, the hinge member 150 has its planar wall 154 aligned with the distal end 142 of bearing member 140. The planar wall 154 may be oriented in other positions about axis 155 depending on the orientation of surface 163. Accordingly, the hinge member 150 is secured against rotation relative to the bearing member 140. Retainer member 160 may be provided with a suitable bore 160*a* for receiving a support shaft 62*a* of a guide roller 62 or a similar guide member for the door 20.

Referring further to FIG. 10, a support member 170 is disposed in bore 150*a* of hinge member 150 at its opposite end, as shown, and retained in the bore by a retainer member 172 having a radially projecting arm portion 174 with a sectional configuration similar to the arm portion 165 of retainer member 160. Arm portion 174 may be secured to wall 74*a* of the opposite end stile 42, also by a self-tapping threaded fastener 167 projecting through wall 74*a* and a reinforcing member 100, as shown. However, members 170 and 172 are not secured to each other and member 170 has a reduced diameter hub portion 171 which projects through a bore 178 formed in a boss 180 of retainer member 172. Boss 180 is spaced from the body of member 170 which is delimited by a transverse shoulder 170*b*. Shoulder 170*b* is spaced from retainer boss 180 a sufficient distance to allow differential thermal expansion between door section 20*b*, for example, and the hinge member 150. Support member 170 may include a bore 170*a* for supporting a shaft 62*a* of a door guide roller 62, as illustrated.

The support member 170 and retainer member 173 may be assembled to the door section 20*b* after the hinge assembly is assembled and the hinge member 150 is rotated to its working position and retained therein by a retainer 160, as described above. If it is desired to disassemble a door section from its adjacent connected door section, the retainer member 172 and support member 170 are also preferably removed from the door section 20*b*, for example, before the hinge member 150 is rotated to a position to permit separation of the door sections from each other.

Referring briefly to FIG. 6B, the cross-sectional configuration of extruded elongated bottom rail 52 is similar in some respects to the rails 38, 40 and 48 in that a transverse ornamental end wall 182 is provided which is substantially identical to the end walls 78, 114 and 134. End wall 182 is connected to opposed, spaced apart, planar side walls 184 and 186 which are also interconnected by a transverse bottom wall 188 and an intermediate wall 190, leaving an interior space 192 for insertion of a reinforcing member, such as a tubular member 96*t*, or one of the aforementioned channel members 96. The bottom wall 188 is interposed downwardly projecting opposed bosses 191 having suitable grooves formed therein for supporting and retaining a resilient bottom seal member 193, as shown. As described above, the bottom rail 52 may also be formed of extruded polymer material, such as vinyl, and is assembled to form the door section 20*d* by mitered joints 20*m*, FIG. 2, between the bottom rail 52, the end stiles 42 and a rail member 48.

Figure 13:
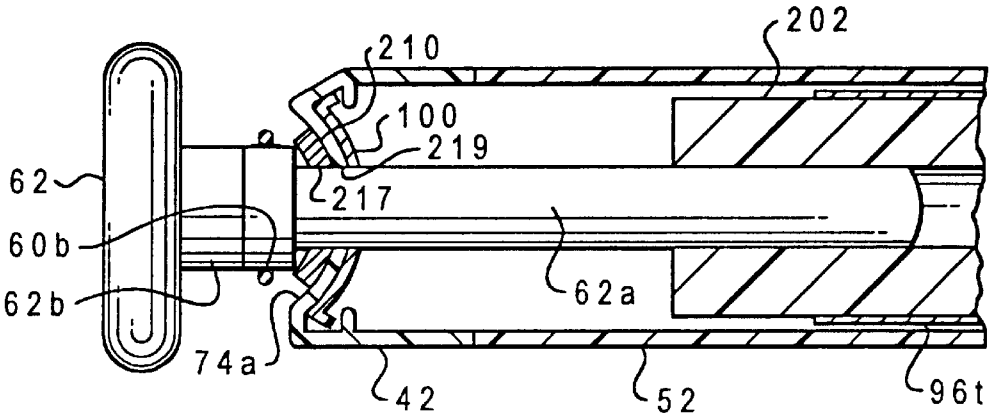
FIG. 13 is a section view taken generally along the line 13—13 of FIG. 14.
Figure 14:
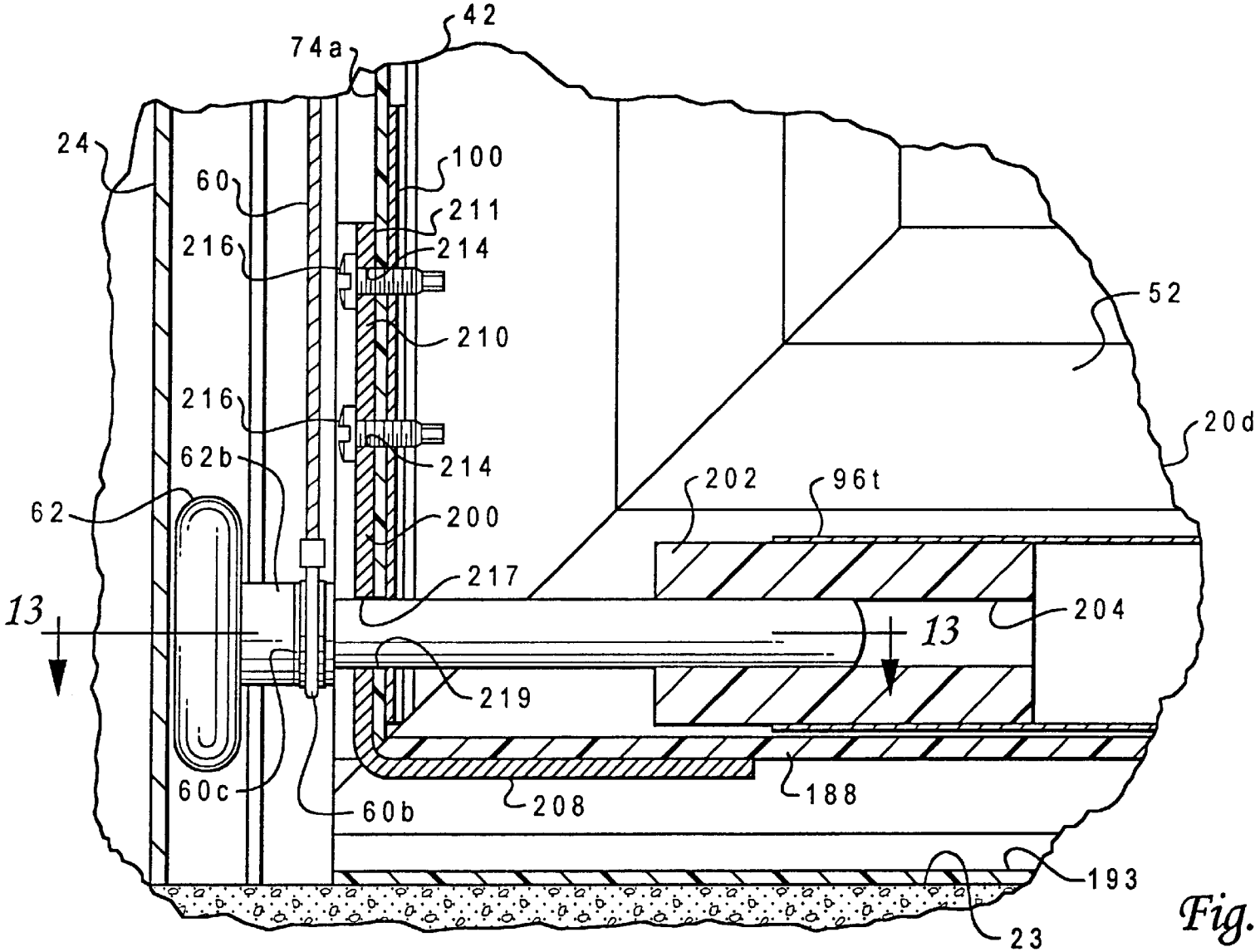
FIG. 14 is a section view taken generally from the line 14—14 of FIG. 6B

Referring now to FIGS. 13 and 14, one lower corner of door section 20*d* is illustrated. The opposite lower corner is of identical construction and is connected to a guide roller 62 in the manner illustrated in FIGS. 13 and 14. The lowermost guide roller 62 includes a hub portion 62*b* which is adapted to be connected to one of the counterbalance cables 60 in a conventional manner. For example, referring to FIG. 14, the cable 60 may be formed to have an eye 60*b* trained around a thimble 60*c* which is sleeved over hub 62*b*. The support shaft 62*a* for roller 62 projects through a bracket, generally designated by numeral 200, end wall 74*a*, a reinforcing member 100 and is supported in a bearing block 202 having a suitable bore 204 formed therein. The bearing block 202 is of generally square cross-sectional configuration so that it may be snugly fitted within the end of a tubular reinforcing member 96*t*, for example. Alternatively, if the reinforcing member 96*t* is a channel member 96 the bearing block 202 may also be fitted within such member.

The bottom bracket 200 is of a somewhat L-shaped configuration having a transverse bottom leg 208 operable to be engaged with the wall 188 of bottom rail 52 and extending therealong from wall 74 of end stile 42. The bracket 200 includes an upstanding leg 210 having a somewhat arcuate cross-sectional shape, see FIG. 13, defining a curved surface 211 engageable with concave curved wall 74*a* of end stile 42, as shown. The leg 210 of bracket 200 has at least two spaced apart fastener receiving bores 214 formed therein for receiving suitable self-tapping threaded fasteners 216 for threaded engagement with the wall 74*a* and a reinforcing member 100 disposed as shown in drawing FIGS. 13 AND 14. Bores 217 and 219 are formed in leg 210 of bracket 200 and wall 74*a* for receiving guide roller shaft 62*a* in close fitting relationship to the shaft. Bracket 200, in particular, acts as a load-bearing member when the shaft is subject to a lateral load such as exerted by the counterbalance cables 60. Accordingly, the roller shaft 62*a* is supported by the bracket 200, reinforcing member 100 and by the bearing block 202.

By placing the fasteners 21b along the bracket leg 210 in registration with the vertical end wall 74*a* of stile 42, in the position indicated in FIG. 14, access to these fasteners for removing them while the cable 60 is under tension and the door is assembled in its tracks 42 is substantially prevented. Only when the tension in cable 60 has been purposely reduced and the door has been at least partially removed from its guide tracks can the fasteners 21*b* be accessed for removal of the bracket 200 and the cable removed from its connection with hub 62*b* of the roller assembly 62. Moreover, the configuration of the somewhat L-shaped bracket 200 with the vertical leg 210 and the transversely extending integral leg 208 is advantageous in that an upward acting force, viewing FIG. 14, exerted by the cable 60, will cause the roller shaft 62*a* to transfer forces through the bracket 200 to the bottom of the door defined by stile 42 and to the bottom rail 52 through the shaft 62*a*. Moreover, the leg 208, being urged upward by the forces exerted on the bracket by the roller shaft 62*a* will also transfer forces to the bottom wall 188 of rail 52 over a relatively extended length so that the distribution of forces acting on the bottom of the door 20 is significant.

The leg 208, may, for example, be approximately three inches to four inches in length while the leg 210 is also of about the same or greater length, as required to provide space for the fasteners 214 and the roller shaft receiving bore 217. In a door having conventional seven foot height by eight to twenty foot width, the above dimensions for a bracket formed of steel, having a thickness of about 0.13 inches are suitable. The width of the leg 210 may be on the order of about 0.87 inches and the width of the leg 208 about 0.50 inches. Although only one bracket 200 is shown in detail assembled to the door section 20*d* in FIGS. 13 and 14, those skilled in the art will appreciate that the opposite lower edge of door section 20*d* has a bracket 200 assembled thereto in an identical manner.

Figure 15:
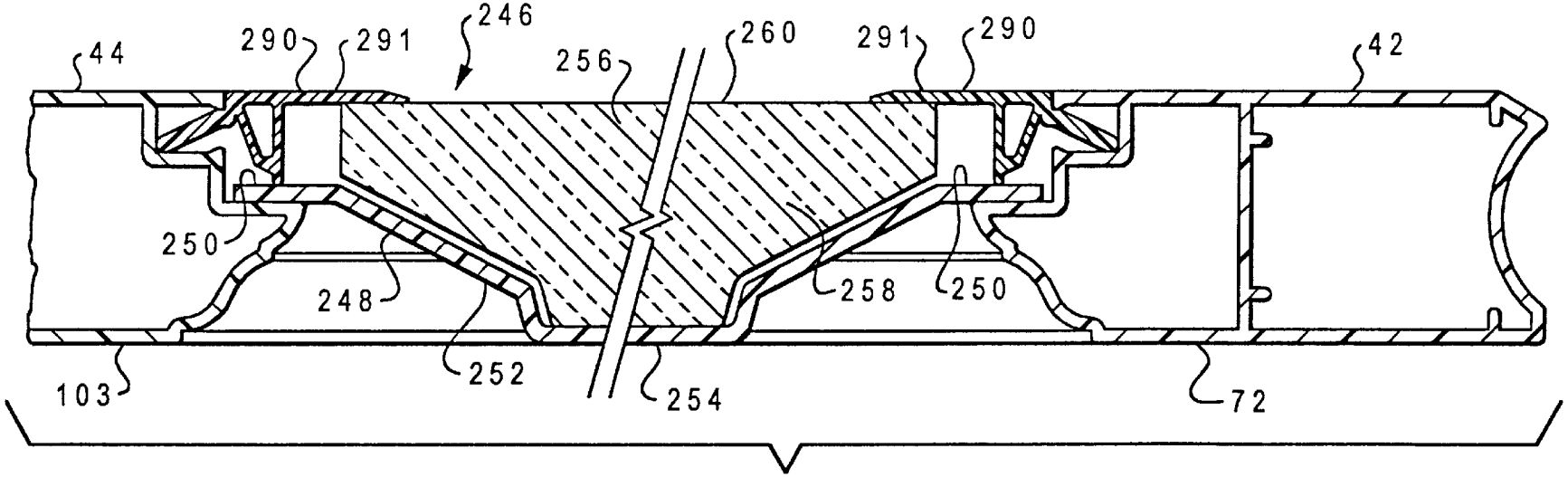
FIG. 15 is a section view taken generally from the line 15—15 of FIG. 1.

Referring now to FIG. 15 there is illustrated an embodiment of a panel insert which is operable to replace the panel inserts 46, and is generally designated by the numeral 246. The panel insert 246 is shown, by way of example, inserted between an end stile 42 and an intermediate stile 44 and retained in engagement therewith by retainers 290 which are similar to the retainers 90 but include an elongated retaining flange portion 291, respectively. The retainers 290 may be of predetermined length to extend along the stiles 42 and 44 as well as along the rails 40 and 48 or, as the case may be, along rails 38 and 52 for retaining panel inserts 246 on the door sections in place of each of the panel inserts 46.

The panel insert 246 includes an outer wall member 248 having a generally rectangular configuration with a generally planar peripheral edge 250 insertable in the recess provided by the wall portions 82 and 84 of each of the stile members and rail members, respectively. Moreover, the outer wall 248 includes a recessed portion 252 which may be delimited by a generally planar wall portion 254 coplanar with the outer sidewall 72 of the stile 42 and the outer sidewall 103 of a center or intermediate stile 44, as shown.

A thermal and/or acoustic insulation member 256 is disposed in engagement with the wall 252 and is retained in such engagement by the retainers 290, as shown in FIG. 15. The insulation member 256 is of generally rectangular configuration and has a contour corresponding substantially to that of the wall 252. A preferred construction for the insulation member 256 is a core portion 258 of expanded polystyrene and a generally planar backplate 260 bonded to the core portion and formed of a high impact polystyrene.

Accordingly, the generally planar noninsulating panel inserts 46 may be easily replaced in the door sections 20*a*, 20*b*, 20*c* and 20*d* by removing the retainers 90 and the panel inserts and substituting the insulation member inserts 246 and the retainers 290 without further modification to the structure of the door 20. Thus, in applications of the door 20 requiring significant thermal and/or acoustic insulation, panels inserts 246 may be easily substituted for the panel inserts 46.

The assembly, disassembly and operation of the door 20 is believed to be readily understandable to those of ordinary skill in the art from the foregoing description of the components thereof. The components not specifically described herein with regard to fabrication details and materials may be constructed using conventional materials and methods used in door manufacture. As mentioned previously, the rails 38, 40, 48 and 52, the end stiles 42 and the intermediate stiles 44 may be fabricated of extruded plastic or the like. The struts 64, 96, 96*t* and 98 and the reinforcing members 100 may be steel or aluminum, for example. However, these components may also be constructed in another manner.

Although preferred embodiments of the invention have been described in detail herein, those skilled in the art will recognize that various substitutions and modifications may be made without departing from the scope and spirit of the invention as recited in the appended claims.

What is claimed is:

1. In an upward acting door characterized by at least one door section, the improvement comprising:

an elongated rail member forming a structural part of said one section and characterized by opposed spaced apart side walls defining an interior space;

a first elongated reinforcing member disposed within said interior space for reinforcing said one section; and a second elongated reinforcing member disposed adjacent an outer surface of one of said side walls and secured to said first reinforcing member by fastener means without forcibly engaging said one side wall whereby said rail member and said reinforcing members may move relative to each other as a result of differential thermal expansion.

2. The door set forth in claim 1 wherein:

said first reinforcing member comprises a generally rectangular cross-section tube disposed in said interior space.

3. The door set forth in claim 1 wherein:

said first reinforcing member comprises a channel-shaped member having opposed flanges and an interconnecting web, one of said flanges being disposed adjacent said one side wall for engaging fastener means extending through fastener receiving openings in said one side wall and engaged with said second reinforcing member.

4. The door set forth in claim 1 wherein:

one of said reinforcing members includes plural spaced apart bosses extending from said one reinforcing member for engagement with the other reinforcing member through plural spaced apart openings in said one side wall.

5. The door set forth in claim 1 wherein:

said second reinforcing member comprises an elongated strut having at least one web portion and one flange portion connected to said one web portion, said strut extending over a major portion of the length of said rail member.

6. The door set forth in claim 1 wherein:

said second reinforcing member extends across a top rail member of said one section and said door includes a bracket connected to said top rail member and adapted to be connected to a door operating mechanism for opening and closing said door.

7. The door set forth in claim 1 wherein:

said door comprises a plurality of door sections hingedly interconnected for movement of said door between open and closed positions; and at least two of said sections include a first reinforcing member disposed within an interior space thereof and a second reinforcing member secured to said first reinforcing member without forcibly engaging a side wall of a section, respectively.

8. The door set forth in claim 7 wherein:

adjacent sections of said door are interconnected by elongated hinge means including a hinge portion connected to a rail member of one section adjacent to a rail member of an adjacent section and each of said rail members includes an elongated first reinforcing member disposed in an interior space thereof and an elongated second reinforcing member disposed adjacent an outer wall surface of said rail member and secured to said first reinforcing member.

9. In an upward acting door characterized by at lease one door section, the improvement comprising:

spaced apart elongated rail members forming a structural part of said one section, each of said rail members being characterized by opposed spaced apart side walls defining an interior space, said rail members being connected by opposed end stiles, each of said rail members and each of said end stiles being formed of extruded plastic members interconnected to form said one section;

both of said rail members including an elongated reinforcing member disposed within interior spaces formed in said rail members, respectively, for reinforcing said one section; and said end stiles each comprise spaced apart side walls interconnected by at least one end wall to define an interior space and said interior space of each of said end stiles includes a reinforcing member insert disposed therein and engageable with said one end wall for reinforcing said one end wall for attachment of faster means to said one end wall.

10. In an upward acting door comprising at least one door section, the improvement comprising:

an elongated rail member forming a structural part of said one section and characterized by opposed spaced apart sidewalls and opposed spaced apart endwalls connected to said sidewalls and defining an interior space, said rail member being formed of an extruded polymer;

a first elongated reinforcing member disposed within said interior space for reinforcing said one section;

a plurality of openings formed in at least one of said side walls of said rail member and spaced apart from each other; and a second elongated reinforcing member disposed adjacent an outer surface of said one sidewall and secured to said first reinforcing member by plural spaced apart fasteners projecting through said openings, respectively and without forcibly engaging said one sidewall whereby said rail member and said reinforcing members may move relative to each other as a result of differential thermal expansion.

11. The door set forth in claim 10 wherein:

said second reinforcing member includes a generally planar web portion and spacer means extending from said web portion for engagement with said first reinforcing member without forcibly engaging said one side wall.

12. The door set forth in claim 10 wherein:

said one section includes two spaced apart elongated rail members interconnected by at least two spaced apart stile members to form a generally rectangular panel of said one section, said rail members and said stile members each being formed of an extruded polymer; and each of said rail members includes an interior space occupied by an elongated reinforcing member for stiffening said one section.

13. The door set forth in claim 12 wherein:

each of said stile members includes an interior space and a reinforcing member disposed in said interior space of said each stile member for forming an anchor for receiving threaded fastener means connected to one section.

14. The door set forth in claim 13 wherein:

said rail members and said stile members are bonded to each other along contiguous lines at mitered joints formed between said rail members and said stile members, respectively.

15. The door set forth in claim 13 wherein:

said one section includes panel inserts removably secured to at least one of said rail members and one of said stile members by removable retainer means whereby said panel inserts may be interchanged with other panel inserts for said one section.

16. In an upward acting door characterized by at least one door section, the improvement comprising:

first and second spaced apart elongated rail members forming a structural part of said one section, at least said first rail member being characterized by opposed spaced apart side walls defining an interior space and a first elongated reinforcing member disposed within said interior space for reinforcing said one section, said first and second rail members each including elongated channel-shaped recesses extending substantially parallel to each other and facing each other, respectively;

spaced apart transverse stile members interconnecting said first and second rail members, each of said stile members including an elongated channel-shaped recess extending substantially parallel to each other and facing each other, respectively;

each of said first and second rail members and said stile members being formed of an extruded polymer and said rail members are connected to said stile members by one of thermal and chemical bonding;

at least one generally rectangular panel insert supported on said one section between said first and second rail members and between said spaced apart stile members; and removable retainer means releaseably insertable in said channel-shaped recesses in said rail members and said stile members, respectively, for retaining said panel insert in a working position on said one section.

17. The door set forth in claim 16 wherein:

said panel insert includes a wall member adapted to be retained in said working position supported by said rail members and said stile members by said retainer means and an insulation member engageable with said wall member of said panel insert and retained in a working position on said one section by said retainer means.

18. The door set forth in claim 17 wherein:

said insulation member comprises a generally rectangular panel member having an insulation body portion and an impact resistant sheet portion secured to said insulation body portion.

* * * * *